US008047625B2

(12) United States Patent
Miyamoto

(10) Patent No.: US 8,047,625 B2
(45) Date of Patent: Nov. 1, 2011

(54) LIQUID EJECTION CONTROL DEVICE, LIQUID EJECTION CONTROL METHOD, LIQUID EJECTION CONTROL PROGRAM, AND LIQUID EJECTION DEVICE

(75) Inventor: Toru Miyamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 761 days.

(21) Appl. No.: 12/218,311

(22) Filed: Jul. 14, 2008

(65) Prior Publication Data

US 2009/0195580 A1 Aug. 6, 2009

(30) Foreign Application Priority Data

Jul. 12, 2007 (JP) ..... 2007-183266

(51) Int. Cl.

| | |
|---|---|
| ***B41J 29/393*** | (2006.01) |
| ***B41J 29/38*** | (2006.01) |
| ***B41J 2/15*** | (2006.01) |
| ***B41J 2/145*** | (2006.01) |
| ***B41J 2/155*** | (2006.01) |

(52) U.S. Cl. ..... 347/19; 347/13; 347/41; 347/42

(58) Field of Classification Search ..... 347/19, 347/13

See application file for complete search history.

(56) References Cited

U.S. PATENT DOCUMENTS

2007/0139715 A1* 6/2007 Kazama et al. ..... 358/3.07

FOREIGN PATENT DOCUMENTS

JP 2003-118149 4/2003

* cited by examiner

*Primary Examiner* — Uyen Chau N Le
*Assistant Examiner* — Kajli Prince
(74) *Attorney, Agent, or Firm* — Nutter McLennan & Fish LLP; John J. Penny, V.

(57) ABSTRACT

A liquid ejection control device controlling a liquid ejecting mechanism having a plurality of liquid ejection heads, includes a dividing unit to which image data consisting of a plurality of pixels is inputted and which divides the image data into a plurality of pieces of divided image data, each corresponding to pixels which undergo a liquid ejection, of each of the liquid ejection heads, a correction data acquiring unit which acquires correction data eliminating a deviation of liquid ejection locations of the plurality of liquid ejection heads, a correcting unit which corrects the divided image data on the basis of the correction data, and a liquid ejection controlling unit which performs liquid ejection control by which each of the liquid ejection heads is driven on the basis of the divided image data which is corrected.

6 Claims, 13 Drawing Sheets

FIG. 12

60

| TEMPERATAURE | MASKING RATIO |
|---|---|
| $T \leq T1$ | 100% |
| $T1 < T \leq T2$ | 75% |
| $T2 < T \leq T3$ | 50% |
| $T3 < T \leq T4$ | 25% |
| $T4 < T$ | 0% |

LIQUID EJECTION CONTROL DEVICE, LIQUID EJECTION CONTROL METHOD, LIQUID EJECTION CONTROL PROGRAM, AND LIQUID EJECTION DEVICE

BACKGROUND

1. Technical Field

The present invention relates to a liquid ejection control device, a liquid ejection control method, a liquid ejection control program, and a liquid ejection device, and more particularly to a liquid ejection control device which controls a liquid ejecting mechanism having a plurality of liquid ejection heads, a liquid ejection control method, a liquid ejection control program, and a liquid ejection device.

2. Related Art

Generally, a printing device is equipped with a plurality of print heads for countermeasures against heat and abnormal liquid ejection nozzles. For example, in the case in which some nozzles of a principal print head are out of order, image data corresponding to the nozzles which are out of order can be printed by corresponding nozzles of a backup print head. For example, when using such a printing device disclosed in JP-A-2003-118149, there can be a problem in which printing ink ejected by plural print heads is present on the same printing result (on the same print paper).

However, if both print heads are not sufficiently accurately aligned with each other, there is the possibility that location for ink ejection from nozzles adjacent to the certain nozzles of the principal print head and location for ink ejection from the nozzles of the backup print head, which correspond to the certain nozzles of the principal print head, overlap each other. That is, in the case in which the printing results obtained by the plurality of print heads are present in a mixed form on the same print paper, if the alignment of the print heads is not perfectly accomplished, there is the possibility that the ink ejection locations overlap with each other, and thus streak-shaped blur may be present in the printing result.

SUMMARY

An advantage of some aspects of the invention is that it provides a liquid ejection control device in which, in a liquid ejection device equipped with a plurality of print heads, ink ejection blur is unlikely to occur even if ink is ejected from the plurality of liquid ejection heads to the same liquid ejection target and a clean ink ejection result can be obtained, a liquid ejection control method, a liquid ejection control program, and a liquid ejection device.

According to one aspect of the invention, there is provided a liquid ejection control device including a liquid ejecting mechanism having a plurality of liquid ejection heads. Here, a dividing unit divides image data consisting of a plurality of pixels into a plurality of pieces of divided image data consisting of pixels, which undergo a liquid ejection, of each of the liquid ejection heads when the image data is inputted. Each of the plurality of pieces of divided image data does not contain any overlapping portions and an image corresponding to the image data is formed on a medium to which liquid is ejected when the liquid ejection is performed on the basis of the divided image data by the liquid ejection heads. A correction data acquiring unit acquires correction data which eliminates a deviation of locations of the liquid ejection heads. The acquisition of the correction data here includes processing of receiving the correction data from an external device, processing of reading the correction data stored in a storage medium with which the liquid ejection control device can be equipped, and processing of producing and acquiring the correction data. A correcting unit corrects the divided image data on the basis of the correction data. A liquid ejection control unit performs liquid ejection control to drive the liquid ejection heads on the basis of the divided image data which is corrected.

According to this aspect, the image data representing an object image, which is supposed to be formed by the liquid ejection, is divided into a plurality of pixel groups (divided image data) so as to correspond to the liquid ejection heads used for liquid ejection, and each divided image data is corrected using the correction data in order to correct the misalignment of liquid ejection locations of the liquid ejection heads. As a result, the deviation between liquid ejection locations of the liquid ejection heads is eliminated, and the liquid ejection results obtained by the liquid ejection heads on the basis of the divided image data do not overlap with each other, and thus the liquid ejection blur attributable to the misalignment of the locations of the liquid ejection heads is eliminated. As a result, it is possible to obtain good quality of liquid ejection result.

According to another aspect of the invention, the correction data is generated on the basis of the results of the liquid ejections performed using predetermined test patterns provided for the liquid ejection heads, respectively. The predetermined patterns include at least a pattern representing a parallel direction of the liquid ejection nozzles of the print heads and a pattern representing a movement direction of the liquid ejection heads, which is relative to a medium to which the liquid is ejected. With such a structure, a difference of inclinations between the liquid ejection heads, a difference of locations in a horizontal direction between the liquid ejection heads, a difference of locations in a vertical direction between the liquid ejection heads are obtained on the basis of the liquid ejection results of the test pattern, and thus the correction data which can eliminate these differences is produced.

According to further aspect of the invention, the correcting unit generates correction data which harmonizes the liquid ejection result by one liquid ejection head of the plurality of liquid ejection heads with the liquid ejection result by the other liquid ejection head using the above-mentioned correction data. With such a structure, since the liquid ejection result by one liquid ejection head is used as a reference for correction and the liquid ejection result by the other liquid ejection head is harmonized with the reference, the amount of the correction data and the number of processing needed for the correction are suppressed to the minimum and it is possible to obtain good quality of liquid ejection result.

According to still further aspect of the invention, the correcting unit generates correction data which corrects the liquid ejection results obtained by the plurality of liquid ejection heads to be formed at a predetermined reference location. Correcting the liquid ejection results to be formed at the reference location does not mean the operation in which the liquid ejection result obtained by a certain liquid ejection head is harmonized with the liquid ejection result by obtained the other liquid ejection head but means the operation in which an absolute position on the medium which is a target of the liquid ejection and a predetermined portion of a predetermined liquid ejection head are set as a reference, and the position and the portion are set in a proper direction (the direction in which a pixel row and a pixel column of the inputted image data are perpendicular to each other, or the direction in which the pixel row and the pixel column have a predetermined relationship with ends of the medium, which is a target of the liquid ejection).

According to another structure, the dividing unit generates dividing masks for masking a predetermined ratio of pixels of the image data in a predetermined masking pattern, the pixels masked by the dividing masks form the divided image data corresponding to one liquid ejection head, and the pixels which are not masked by the dividing masks of the image data form the divided image data corresponding to the other liquid ejection head. With such a structure, it is possible to easily divide the image data into the plurality of pieces of divided image data corresponding to the liquid ejection heads, respectively by put the dividing masks on the image data in an overlapping manner. Moreover, when the number of the liquid ejection heads is larger than 2, pixel groups which can not be masked by a single dividing mask may be masked by using an additional dividing mask.

The liquid ejection control device can be implemented in the state of being incorporated in other apparatuses or with other methods. The invention can be realized by a liquid ejection system equipped with the above-mentioned liquid ejection control device, a control method having processes corresponding to the structure of the above-mentioned device, a program which causes a computer to execute functions corresponding to the structure of the above-mentioned device, and a recording medium in which the program is recorded and which is readable by a computer. Inventions of the liquid ejection system, the liquid ejection device, liquid ejection method, the liquid ejection control program, the recording radium having the program therein have the same operations and advantages described above. The structure disclosed in claims 2 to 5 can be applied to the system, the method, the program, and the recording medium.

BRIEF DESCRIPTION OF THE DRAWINGS

The invention will be described with reference to the accompanying drawings, wherein like numbers reference like elements.

FIG. 12 is a view illustrating an exemplary table for determining a mask.

DESCRIPTION OF EXEMPLARY EMBODIMENTS

Hereinafter, embodiments of the invention will be described in the following order:

(1) Overall structure;

(2) Production and setting of correction data;

(3) Liquid ejection control processing;

(4) Selection of divided mask; and (5) Conclusion.

(1) Overall Structure of a Liquid Ejection Control Device

Figure 1:
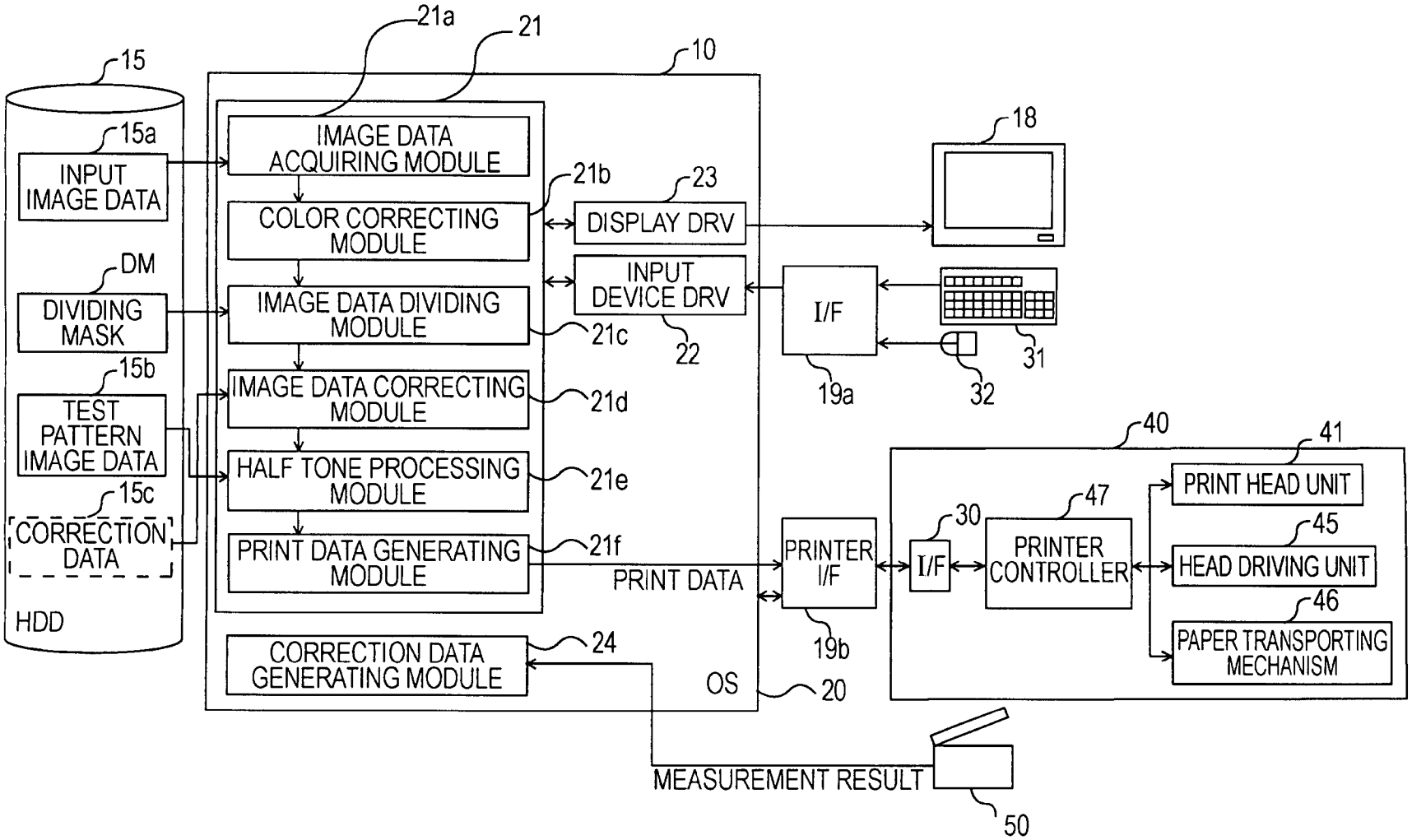
FIG. 1 is a block diagram illustrating an overall structure of a device according to one embodiment of the invention.

FIG. 1 shows the overall structure of a computer according to one embodiment of the invention. The computer 10 is equipped with a CPU (central processing unit) (not shown) which is the core part of the operation processing and a storage medium such as, read only memory (ROM) and random access memory (RAM) and executes a predetermined program using peripheral devices, such as a HDD (hard disk drive) 15. The computer 10 is connected to a printer 40 which is a liquid ejection device via a printer I/F 19*b* (for example, serial I/F). Besides the printer 40, the computer 10 is connected to a manipulation input device, such as a key board 31 and a mouse 32 via an I/F 19*a*. Moreover, it is also connected to a display unit 18 via a video board (not shown). The computer 10 is the core part for controlling the printer 40 and can be called a liquid ejection control device. Alternatively, the aggregation of the computer 10, the printer 40, and other devices also can be called a liquid ejection control device.

In the computer 10, a printer driver 21, an input device driver 22, and a display driver 23 are incorporated in an OS (operating system) 20. The display driver 23 is a driver used for controlling display of a print image on the display 18 or controlling display of screens of predetermined user interfaces (UI). The input device driver 22 is a driver used for allowing predetermined input manipulation by receiving a code signal which is inputted via the I/F 19*a* from the key board 31 and/or the mouse 32.

The printer driver 21 can cause the printer 40 to perform printing operation by performing predetermined image processing with respect to an image which is an object of a print instruction by an application program (not shown). The printer driver 21 consists of an image data acquiring module 21*a*, a color correcting module 21*b*, an image data dividing module 21*c*, an image data correcting module 21*d*, a half tone processing module 21*e*, and a print data generating module 21*f* in order to perform the print control. The OS 20 has a correction data generating module 24 used for generating correction data to be described below and incorporated therein.

When the printing instruction is issued, the printer driver 21 starts to drive and sends data to the display driver 23. Thus the UI screen is displayed. When a user inputs print condition using the UI by manipulating the key board 31 and the mouse 32, all of the modules of the printer driver 21 start to drive. That is, processing for each pixel of an input image data (image data representing printing object image) 15*a* is performed by each module, and print data (raster data) is generated. The generated raster data is outputted to the printer 40 via the printer I/F 19*b* and the printer 40 performs printing using the raster data. Functions of the modules will be described below.

The printer 40 is equipped with a print head unit 41 which ejects a plurality of colors of ink to print paper (recording medium, liquid ejection medium). With this embodiment, in the printer 40, C (cyan), M (magenta), Y (yellow), and K (black) colors of ink is ejected. The printer 40 can express various colors by combining ink of the colors and thus can form a color image on the print paper. It is apparent that the number and kinds of the ink used in the printer 40 be not limited to the above description. That is, various kinds of ink, such as Lc (light cyan), Lm (light magenta), Lk (gray), and LLk (light gray) can be used.

The printer 40 is equipped with a communication I/F 30 connected to the printer I/F 19*b*. The computer 10 and the printer 40 can mutually communicate with each other via the printer I/F 19*b* and the communication I/F 30. The communication I/F 30 can receive raster data for every kind of ink which is sent from the computer 10. The printer 40 is equipped with a CPU and a storage medium such as ROM and RAM (not shown), and executes a predetermined program (printer controller 47). The printer controller 47 is a program which performs various kinds of control for print processing. All of mechanism inside the printer 40, such as the print head unit 41 (a kind of liquid ejecting mechanism), a head driving unit 45, a paper transporting mechanism 46 are control objects of the printer controller 47.

The print head unit 41 is equipped with a plurality of nozzles which ejects colors of ink and has ink cartridges which supply colors of ink to corresponding nozzles. With this embodiment, the printer 40 is a line head type printer. Accordingly, in the print head unit 41, a plurality of nozzles is densely arranged in a perpendicular direction to a paper transportation direction of the print paper. Alternatively, the printer 40 may have a serial type print head. The printer controller 47 outputs application voltage data corresponding to the raster data to the head driving unit 45. The head driving unit 45 generates and outputs an application voltage pattern (driving signal) to piezoelectric elements arranged so as to correspond to the nozzles, respectively, of the print head unit 41 using the application voltage data, and causes the print head unit 41 to eject ink droplets (dots) of the colors of ink from the nozzles thereof. However, besides the method of using deformation of the piezoelectric elements based on the driving signal, various methods such as a thermal method may be used as a method of forming the dots. The paper transporting mechanism 46 is controlled by the printer controller 47 and transports the print paper in a predetermined paper transportation direction by a paper transporting roller (not shown).

Figure 2:
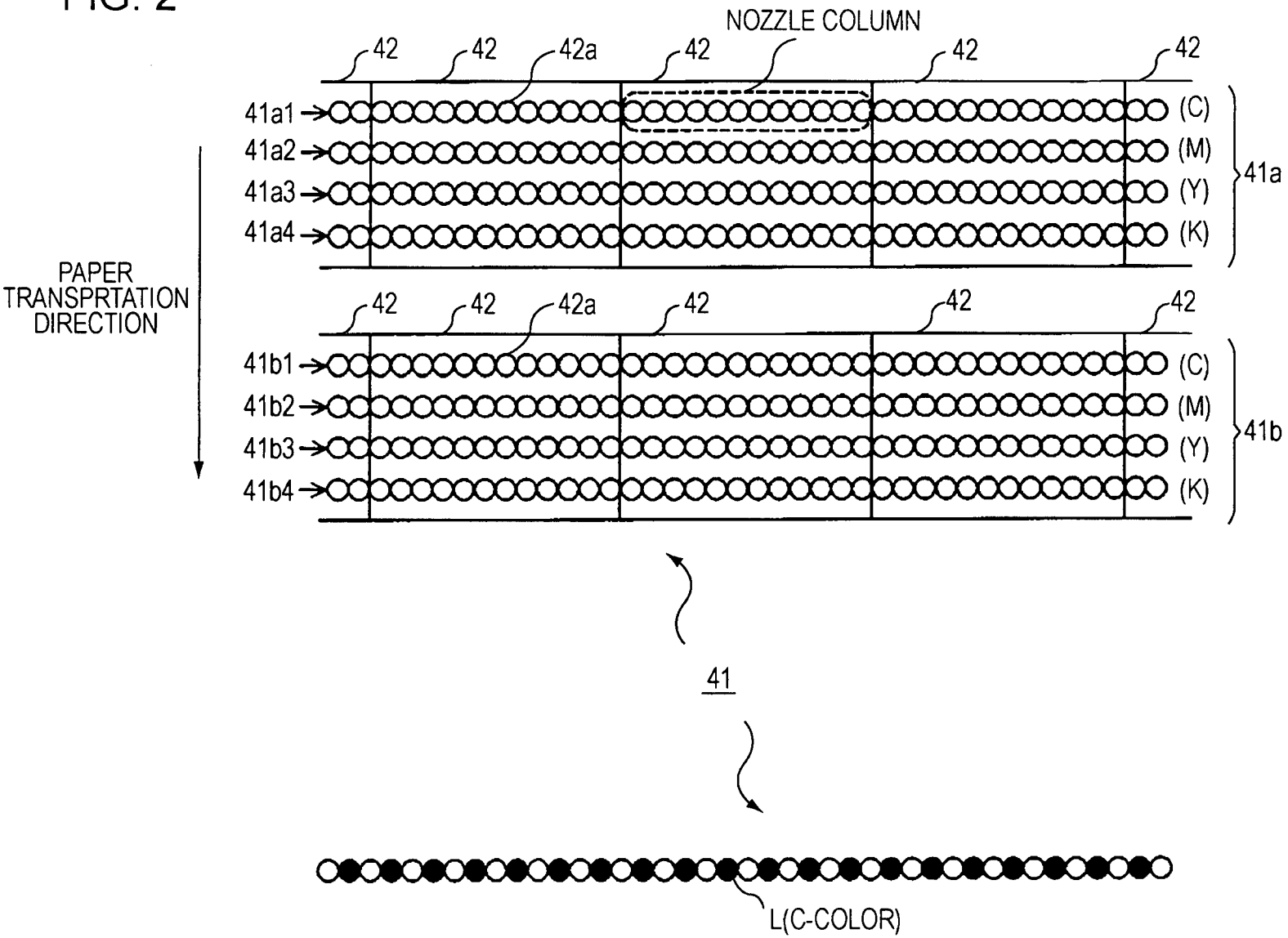
FIG. 2 is a view illustrating a print head unit according to one example of the invention.

FIG. 2 shows part of the surface of the print head unit 41 on which the nozzles are arranged. As shown in the figure, the print head unit 41 consists of a first head unit 41*a* and a second head unit 41*b*. A first head unit 41*a* includes a plurality of print heads 42 arranged in a direction perpendicular to the paper transportation direction in a length range corresponding to the width of the print paper. In the similar manner, a second head unit 41*b* includes a plurality of print heads 42 arranged in the perpendicular direction to the paper transportation direction in a length range corresponding to the width of the print paper. Each of the printer heads 42 includes a plurality of columns of nozzles 42*a*. The number of columns of the nozzles 42*a* is the same as the number of colors (four (4) colors of C, M, Y, and K) of ink used by the printer 40. Accordingly, the first head unit 41*a* includes nozzle columns 41*a*1, 41*a*2, 41*a*3, and 41*a*4 which correspond to colors of ink, respectively, and has a length corresponding to the width of the print paper. In the similar manner, the second head unit 41*b* includes nozzle columns 41*b*1, 41*b*2, 41*b*3, and 41*b*4 which correspond to colors of ink, respectively, and has a length corresponding to the width of the print paper. Each of the nozzle columns 41*a*1, 41*a*2, 41*a*3, 41*a*4, 41*b*1, 41*b*2, 41*b*3, and 41*b*4 includes N nozzles 42*a*.

In such a head unit 41, each of the first head unit 41*a* and the second head unit 41*b* is equipped with nozzle columns used for ejecting colors of ink C, M, Y, and K, respectively. In this aspect, in the print head unit 41, the number of nozzle columns for each color is plural. The nozzle columns (a kind of nozzle group) for each color are plural. For example, the nozzle group for C ink consists of the nozzle columns 41*a*1 and 41*b*1. That is, the print head unit 41 has a plurality of nozzle groups.

In the print head unit 41, a plurality of nozzle columns corresponding to the same color of ink can be selectively used in the unit of dot. As shown in a lower portion of FIG. 2, the case in which a raster line L by a certain ink color (for example, C) is printed in a direction perpendicular to the paper transportation direction. In this case, in the print head unit 41, all of N dots constituting the raster line L can be printed by the nozzles 42*a* of the nozzle column 41*a*1. All of the dots can be printed by the nozzles 42*a* of the nozzle column 41*b*1. Further, the nozzles 42*a* of the nozzle columns 41*a*1 and 41*b*1 can be alternately used in the unit of a dot. As shown in the same figure, dots indicated by white circles of the raster line L are printed by the nozzles 42*a* of the nozzle columns 41*a*1 and black circles indicated by the raster line L can be printed by the nozzles 42*a* of the nozzle column 41*b*1. The change of nozzles 42*a* between the nozzle columns 41*a*1 and 41*b*2 is achieved in a manner such that the printer controller 47 chooses an output destination (piezoelectric elements of the nozzles 42*a*) of the driving signal output from the head driving unit 45.

Figure 3:
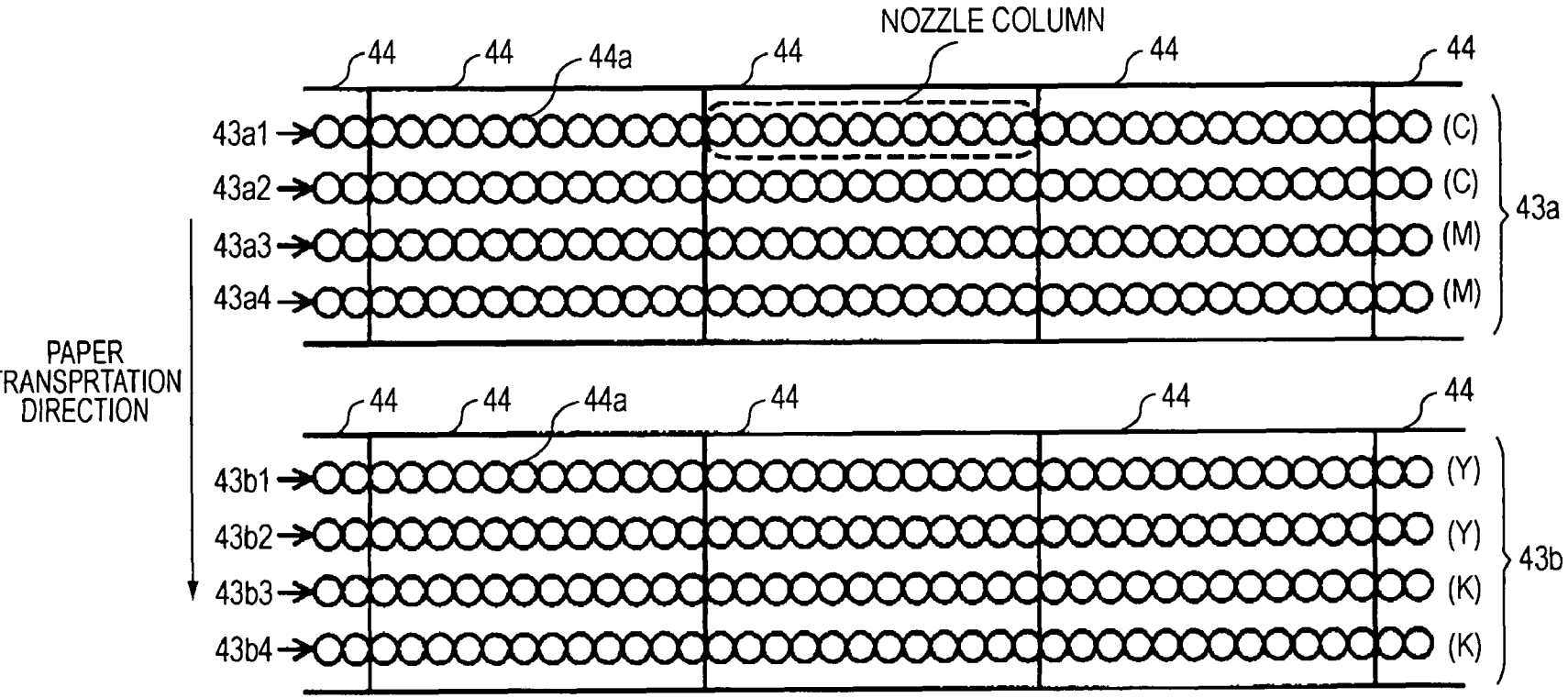
FIG. 3 is a view illustrating a print head unit according to one example of the invention.

FIG. 3 shows the structure of a print head unit according to another example. As shown in the figure, the print head 43 consists of a first head unit 43*a* and a second head unit 43*b*. Each of the first and second head units 43*a* and 43*b* is structured such that a plurality of print heads 44 are arranged in a range corresponding to the width of print paper in a direction perpendicular to the paper transportation direction. Each print head 44 includes nozzle columns. The number of nozzle columns, each having a plurality of nozzles 44*a*, is the same as the number of colors of ink used by the printer 40. Alternatively, however, in the print head unit 43, the nozzle columns 43*a*1, 43*a*2, 43*a*3, and 43*a*4 of the first head unit 43*a* may not be used for eject different colors of ink, respectively, but two neighboring nozzle columns may eject the same color of ink. For example, the nozzle columns 43*a*1 and 43*a*2 are used to eject C ink, and the neighboring nozzle columns 43*a*3 and 43*a*4 are used to eject M ink. In this manner, the nozzle columns 43*b*1, 43*b*2, 43*b*3 and 43*b*4 of the second head unit 43*b* do not correspond to different colors of ink, respectively, but every two neighboring nozzle columns correspond to the same color of ink. For example, the nozzle columns 43*b*1 and 43*b*2 may be used to eject Y ink and the nozzle columns 43*b*3 and 43*b*4 may be used to eject K ink.

However, the structure of the print head incorporated into the printer 40 is not limited to the examples shown in FIGS. 2 and 3. When a plurality of nozzle groups are provided for each color of ink, various structures can be provided. Hereinafter, description is continued with the case in which the print head unit 41 is used as a print head unit.

(2) Production and Setting of Correction Data

In this embodiment, in the procedure of converting the inputted image data 15*a* to print data, correction processing is performed according to installation accuracy (alignment) of the print heads, each constituting the print head unit 41. In such correction processing, correction data which is previously generated is used. Hereinafter, generation of the correction data will be described.

Figure 4:
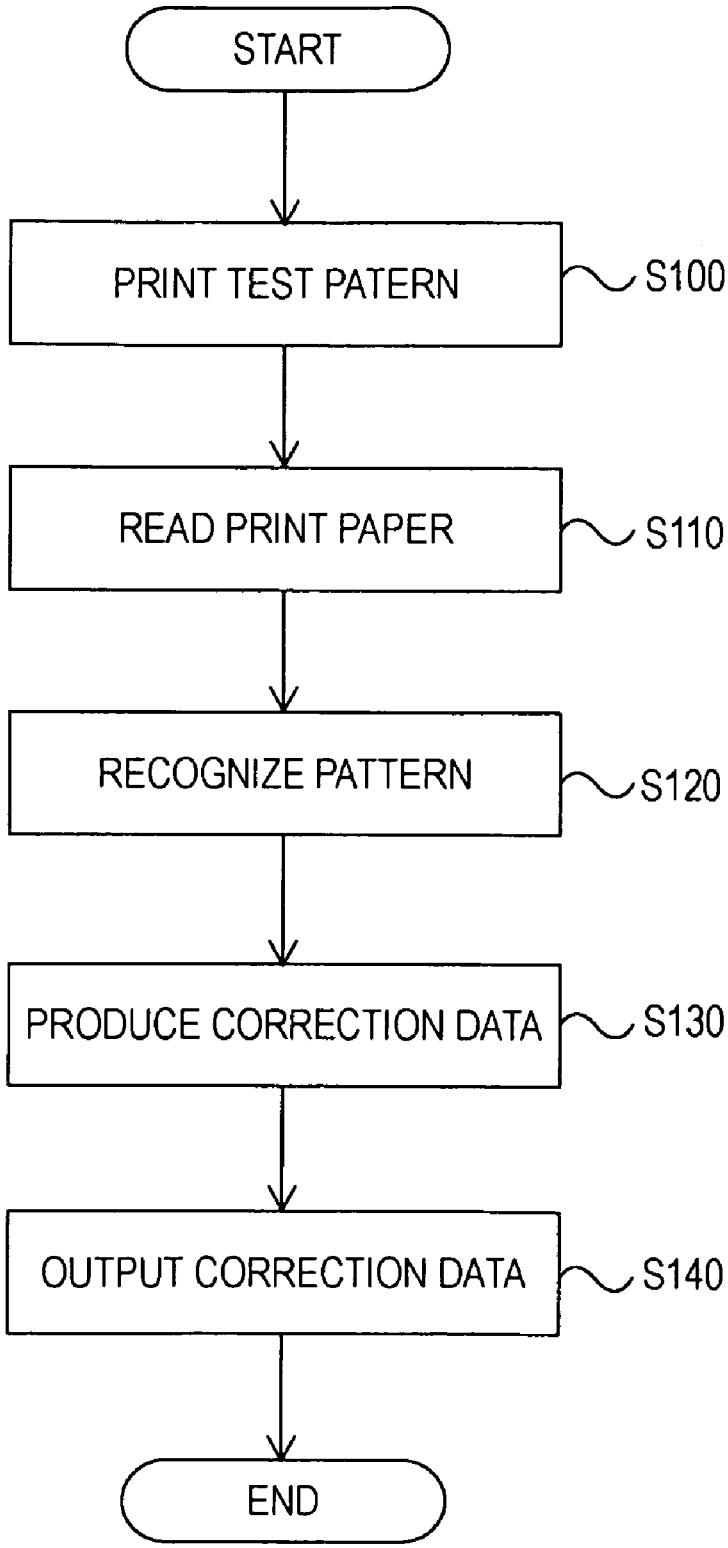
FIG. 4 is a flowchart illustrating processing of producing correction data.

FIG. 4 shows a flowchart of processing of generating correction data, which is performed by the computer 10. Here, the printing result by the first head unit 41*a* is used as reference for correction, and the correction data which corrects the shift of the printing result by the second head unit 41*b* with respect to the printing result by the first head unit 41*a* is corrected using the printing result by the first head unit 41*a* as the reference for correction. With this embodiment, an example in which correction data for one color is generated for each color (for example K) and for each print head unit is explained. This is because it is considered that the nozzle columns of each of the print head are not misaligned. However, the correction data may be generated for each color of ink which is used by the printer.

When the processing is started, in step S100, the computer 10 controls the printer 40 so as to print a predetermined test pattern on print paper. In greater detail, the printer driver 21 first acquires the image data 15*b* representing the test pattern from the storage medium, such as HDD 15. The image data 15*b* includes data containing inclination information of each of the head units, data containing deviation information in a horizontal (left and right) direction, and data containing deviation information in a vertical (up and down) direction.

Figure 5:
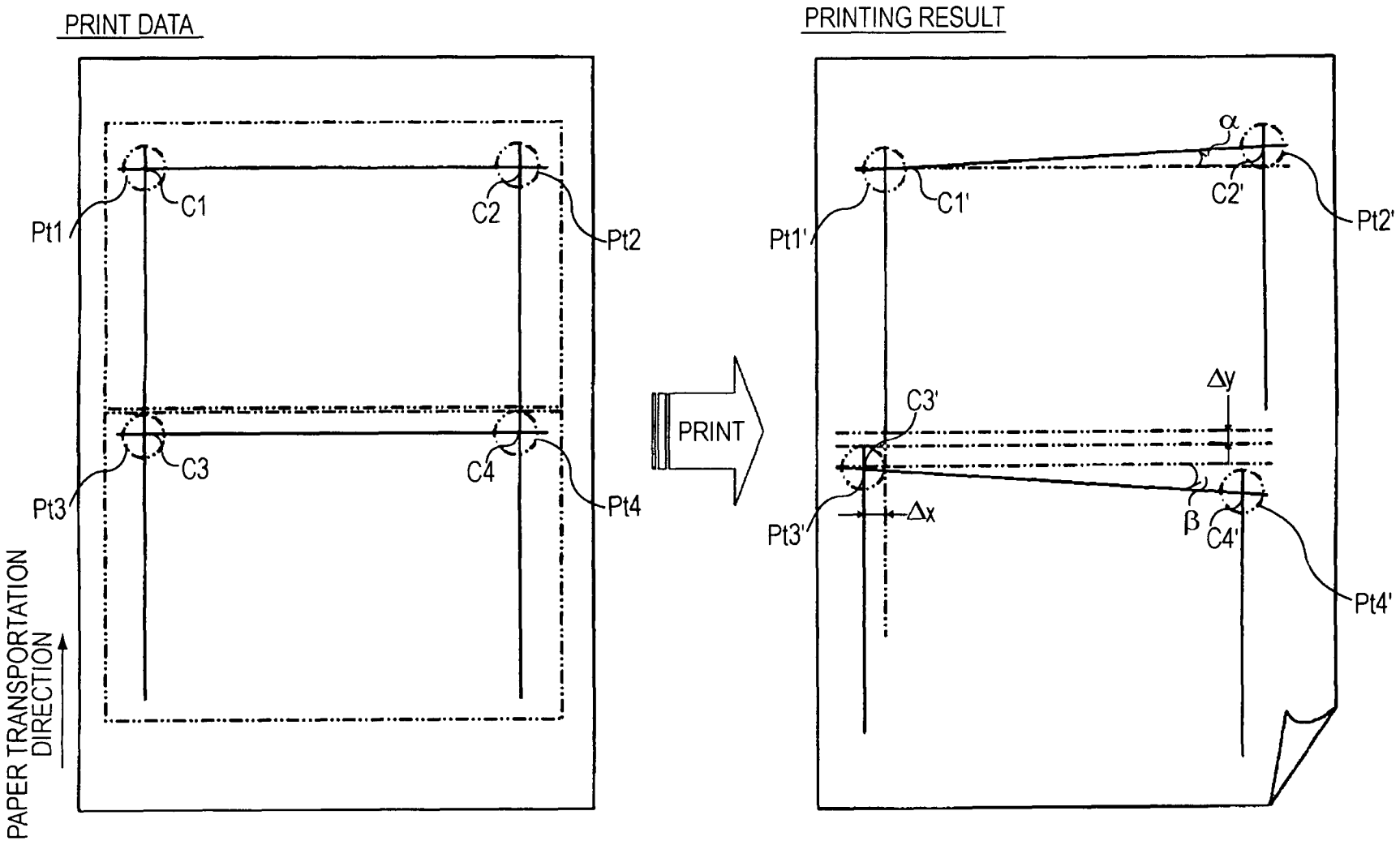
FIG. 5 is a view illustrating a test pattern and one exemplary printing result of the test pattern.

FIG. 5 shows an example of the test pattern and the printing result obtained using the basis of the test pattern. The image data 15*b* of the test pattern in this embodiment consists of four groups of cross shape patterns Pt1, Pt2, Pt3, and Pt4, in which horizontal rule lines and vertical rule lines intersect one another in each group. The positional relationship of the cross shape patterns on the image data 15*b* is that the vertical rule lines of the cross shape patterns Pt1 and Pt2 are arranged on the same straight line, the vertical rule lines of the cross shape patterns Pt3 and Pt4 are arranged on the same straight line, the horizontal rule line of the cross shape patterns Pt1 and Pt3 are arranged on the same straight line, and the horizontal rule lines of the cross shape patterns Pt2 and Pt4 are arranged on the same straight line.

The intersections of the cross shape patterns Pt1 and Pt2 are printed by nozzles, distanced from the each other by a predetermined number of nozzles, of the first head unit 41*a*. On the other hand, the intersections of the cross shape patterns Pt3 and Pt4 are also printed by nozzles, distanced from each other by a predetermined number of nozzles, of the second head unit 41*b*. That is, the horizontal rule line constitutes a pattern representing the arrangement direction of the ink ejection nozzles of the print head unit 41 and the vertical rule line constitutes a pattern representing movement direction of the print head unit 41 with respect to the print paper P.

Accordingly, the distance between the cross shape patterns Pt1 and Pt2 reflects the vertical direction deviation (paper transportation direction deviation) and the horizontal direction deviation (raster direction deviation) of the print head units. Further, a straight line connecting the intersection C1 of the cross shape pattern Pt1 and the intersection C3 of the cross shape pattern Pt3 reflects a deviation of an inclination of the first head unit 41*a*, and a straight line connecting the intersection C2 of the cross shape pattern Pt2 and the intersection C4 of the cross shape pattern Pt4 reflects a deviation of an inclination of the second head unit 41*b*.

Next, the print data generating module 21*f* receives half tone data, generates raster data used by the printer 40 and alternately arranged in order, and outputs the raster data of K to a successive printer 40. The raster data includes identification information for identifying nozzle columns used for ink ejection for each dot, and thus the printer 40 (printer controller 47) performs printing, choosing the nozzles to which the driving signal is supplied. As a result, a predetermined test pattern is printed on the print paper by ejection of K ink from the nozzles 42*a* of the nozzle column 41*a*4.

As the result of printing, as shown in FIG. 5, cross shape patterns Pt1' to Pt4' are printed on the print paper P. In FIG. 5, an inclination of a straight line connecting intersections C1' and C3' with respect to the horizontal direction is defined as $\alpha$, and an inclination of a straight line connecting intersections C2' and C4' is defined as $\beta$. Further, the horizontal direction deviation between the intersections C1' and C2' is defined as $\Delta x$, and a difference between the vertical direction deviation and a predetermined value is defined as $\Delta y$. The predetermined value is a value set such that it is the same as the vertical direction deviation between the intersections C1' and C2' in the cross shape patterns Pt1' and Pt2' printed in the state in which the print head units are completely aligned.

Next, in step S110, the computer 10 receives the reading result of the print paper P by a predetermined reading unit. As shown in FIG. 1, the computer 10 is connected to the reading device 50 (for example, scanner). The reading device 50 can optically measure the printing result of the test pattern by scanning the upper surface of the print paper P, and the reading result can be obtained as brightness information of monochrome 2 tones or monochrome 16 tones. Alternatively, the reading result may be obtained as color tones.

Next, in Step S120, the computer 10 acquires the coordinate of the intersections C1' to C4' of the cross shape patterns in the printing result by recognizing the patterns in the reading results obtained by the reading device 50. The pattern recognition can be performed by various known pattern matching techniques. Information needed to generate correction data by each of equations including $\alpha=\tan-1((y2-y1)/(x2-x1))$, $\beta=\tan-1((y3-y4)/(x4-x4))$, $\Delta x=x2-x1$, and $\Delta y=y2-y1-C$ (C is the predetermined value), on the basis of the coordinate of the intersections C1' to C4'.

Figure 6:
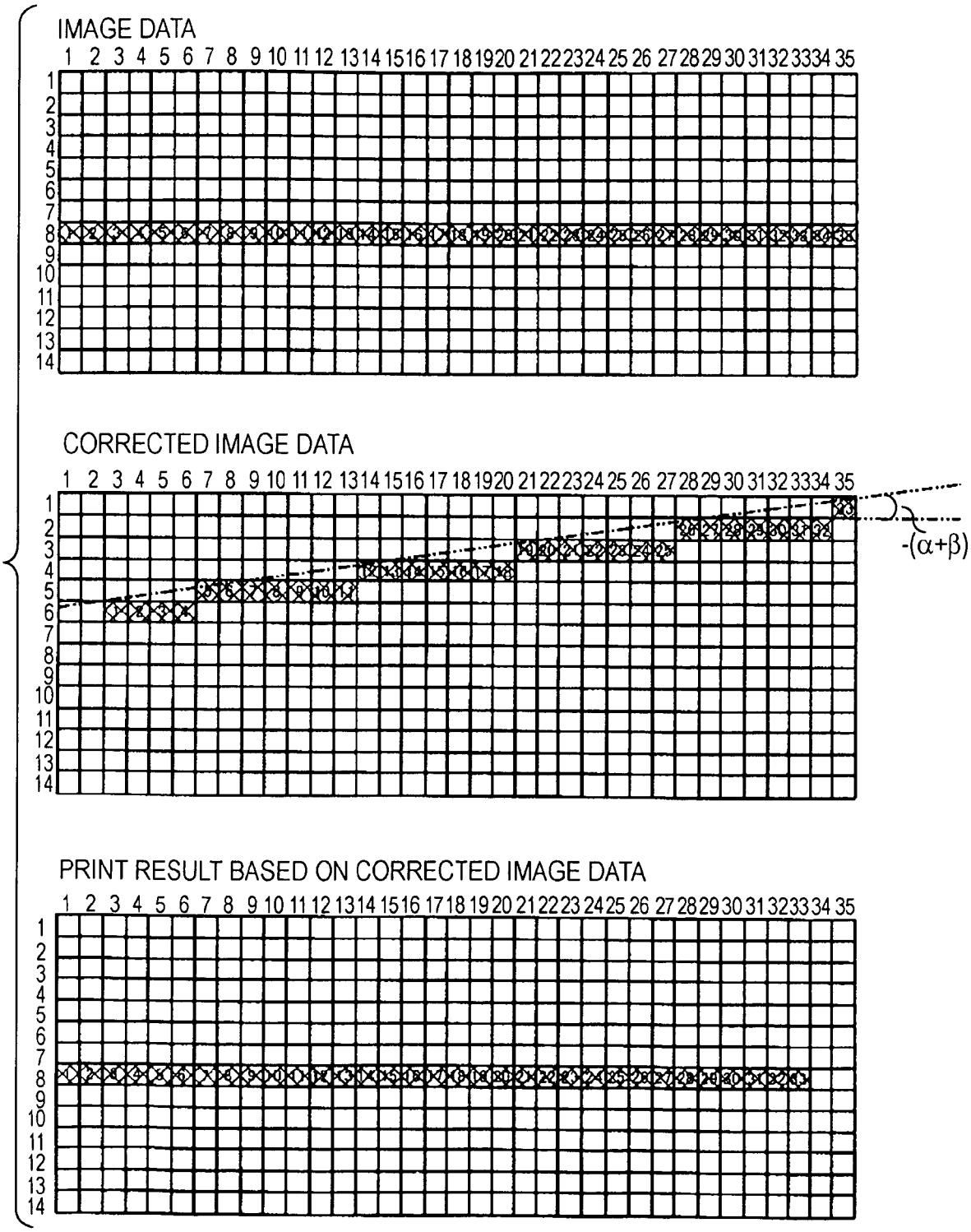
FIG. 6 is a view illustrating correction data.

Next, in step S130, the correction data is generated on the basis of $\alpha$, $\beta$, $\Delta x$, and $\Delta y$ obtained in step S120. The correction data is generated such that the correction shown in FIG. 6 can be performed. That is, in order to correct the deviation of inclination, in the pixels constituting the image data to be printed by the second head unit 41*b*, correction data, by which rotation correction for shifting the pixel columns arranged in a single row in a horizontal direction to a position by the amount of $-(\alpha+\beta)$ while using the leftmost pixel as a center for rotation is performed, is generated. In order to correct the horizontal direction deviation, correction data, by which each of the pixels of the image data to be printed by the second head unit 41*b* is shifted by the amount of $-\Delta x$, is generated. In order to correct the vertical direction deviation, correction data, by which a pixel row is shifted by the amount of $-\Delta y$, is generated. Moreover, as the countermeasure for elongation or shrink in the horizontal direction (left and right direction), correction data, by which correction of elongation or shrink is performed in order to eliminate the ratio change in the horizontal direction, is generated. In the following description, corrections are performed in order of the elongation-or-shrink correction, the rotation correction, and the shift correction. However, the order to the shift correction may be randomly changed. Hereinafter, each of the corrections will be described.

With this embodiment, since the rotation correction for harmonizing the printing result by the second head unit 41*b* with the printing result by the first head unit 41*a* is performed, when $\alpha<\beta$, the printing result by the second head unit 41*b* is compared with the printing result by the first head unit 41*a*. As a result, it is observed that the pixel row shrinks in the horizontal direction (left and right direction). On the contrary, when $\alpha>\beta$ and the printing results by the first head unit 41*a* and the second head unit 41*b* are compared with each other, it is observed that the pixel row elongates. Accordingly, in the elongation-or-shrink correction processing, the correction is performed such that the width of pixels constituting each of the pixel rows is elongated or shrunk.

In greater detail, the left end of each of the pixel row is fixed and the width of each pixel row is multiplied by $\cos\alpha/\cos\beta$ so that each pixel row is elongated or shrunk. That is, when $\alpha<\beta$, each of the pixel rows constituting the divided image data of the second head unit 41*b* is expanded in the horizontal direction (left and right direction). On the other hand, when $\alpha > 62$, each of the pixel rows constituting the divided image data of the second head unit 41*b* is shrunk in the horizontal direction (left and right direction). Through the correction, in the state in which the rotation correction is performed with respect to each of the pixel rows, the width of the pixel row after elongation-or-shrink correction becomes equal to the width of the pixel rows which did not undergo the various corrections. Accordingly, it is possible to prevent the ink ejection locations of the corresponding nozzles of the first head unit 41*a* and the second head unit 41*b* from being misaligned and shifted.

The rotation correction can be expressed by Equation 1 when the coordinate after the rotation correction is (X, Y) and the coordinate before the rotation correction is (x, y):

Equation 1

$$X = x\cos\theta + y\cdot\sin\theta \quad (1),$$

$$Y = -x\sin\theta + y\cdot\cos\theta \quad (2),$$

wherein $\theta$ is expressed by $\theta = \alpha + \beta$ by using the inclination $\alpha$ of the first head unit 41*a* and the inclination $\beta$ of the second head unit 41*b*. With Equation 1 and Equation 2, each pixel row is rotated while having the left end thereof as the rotation center, and thus pixels of each of the pixel row is rotated and moved. According to the overlapping degree of the pixels rotated with respect to each of pixel regions constituting the image data after the correction, data of each of the pixel region after the correction is determined. That is, each pixel data before correction overlaps each of the pixel regions constituting the image data after the correction as the result of the rotation correction, and is allocated to each of pixels after correction according to the overlapping amount.

In order to simplify the rotation correction processing, as the result of the rotation correction, the data of pixels having the highest overlapping ratio may be used as data of the corrected pixels of the uncorrected pixels overlapping with the pixel regions constituting the corrected image data. In this manner, the pixels constituting the input image data and the corrected pixels correspond to one another in one-to-one correspondence. Accordingly, the correction processing in the liquid ejection control processing which will be described later can be realized with a very simple manner.

In the shift processing, the coordinate (X, Y) after the rotation correction is shifted to the coordinate (X', Y'). In greater detail, the coordinates of the pixels, which are obtained by the rotation correction are shifted according to equations of $X' = X - \Delta x$ and $Y' = Y - \Delta y$. As a result, the left and right ends and the upper and lower ends protrude from the range of the corrected image data and a portion which cannot be displayed by the corrected image data is present. However, since the portion is very small when it is considered that correction processing is performed with respect to the print head which is aligned at a certain degree, the portion is not a big problem.

As described above, when taking the rotation of pixels, shift of the pixel positions attributable to elongation-or-shrink of the pixels, which occurs due to the rotation correction, the horizontal direction position shift, and the vertical direction position shift into consideration, a data dividing ratio of the uncorrected pixels to the pixels constituting the corrected image data is generated as the correction data. As described above, if the rotation processing were simplified, the dividing ratio becomes 1, and the one-to-one correspondence relationship of the uncorrected pixels and the corrected pixels becomes the correction data.

Next, in step S140, the computer 10 (the correction data generating module 24) outputs the generated correction data to the printer 40 via the printer I/F 19*b*, and the correction data is stored in a predetermined storage medium provided in the printer 40 (for example, a storage medium provided in a print head unit 41).

(3) Liquid Ejection Control Processing

Figure 7:
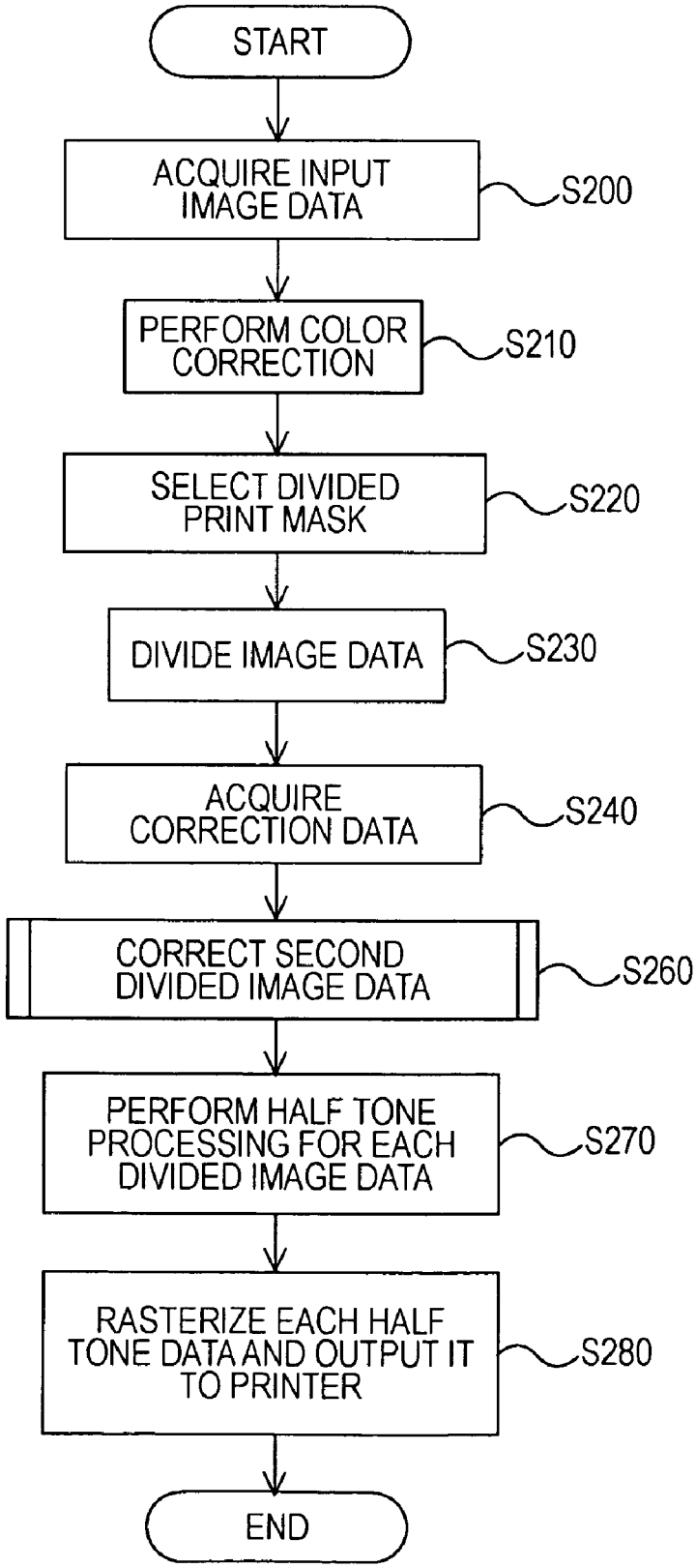
FIG. 7 is a flowchart illustrating liquid ejection control processing.

Next, liquid ejection control processing accompanying the correction processing using the above-mentioned correction data will be described. FIG. 7 is a flowchart illustrating the liquid ejection control processing performed by the computer 10. The processing is mainly performed by the printer driver 21.

In step S200, the image data acquiring module 21*a* acquires the input image data 15*a* from the HDD 15. The input image data 15*a* is data in a dot matrix form, which specifies the color of pixels by gradation of each of element colors including red (R), gray (G), and blue (B). The data is specified by using a color coordinate system according to sRGB specification. Moreover, various kinds of data such as JPEG image data using YCbCr color coordinate system and image data using CMYK color coordinate system can be used. However, besides the HDD 15, the image data acquiring module 21*a* may receive the image data from the image input device, such as digital still camera (not shown) connected to the computer 10. In step S200, predetermined resolution converting processing is performed with respect to the input image data 15*a* according to output resolution of the printer 40 if it is necessary.

In step S210, the color converting module 21*b* converts a color coordinate system of the input image data 15*a* to a color coordinate system of ink colors used by the printer 40. In greater detail, the color converting module 21*b* converts RGB data of the pixels of the input image data 15*a* to gradations (CMYK data) for each of C, M, Y, and K with reference to a color converting look-up table (LUT) (not shown) preliminarily stored in the HDD 15. The color converting LUT is a recorded table in which the CMYK data is recorded with respect to predetermined reference points (RGB data) in sRGB color spaces. The color converting module 21*b* can convert random RGB data to CMYK data by performing interpolating operation with reference to the color converting LUT. With this embodiment, values of CMYK after the color conversion can be displayed in 256 gradations.

Here, nozzle columns for ejecting colors of ink are multiplexed in the print head unit 41. For this reason, when the printing is performed on the basis of the input image data 15*a*, the nozzle columns having the multiplex relationship can be used together. Accordingly, with this embodiment, the image data representing the printing object image can be divided into image data (first divided image data) which is an ink ejection object by some nozzle columns (nozzle columns 41*a*1, 41*a*2, 41*a*3, and 41*a*4) of the multiplexed nozzle columns and image data (second divided image data) which is an ink ejection object by the other nozzle columns (41*b*1, 41*b*2, 41*b*3, and 41*b*4) of the multiplexed nozzle columns.

In step S220, the image data dividing module 21*c* chooses a dividing mask DM which divides the image data into a plurality of pieces of divided image data from a plurality of kinds of dividing masks DM according to predetermined condition. Each of the dividing masks DM is stored in a predetermined storage region such as HDD 15, and the image data dividing module 21*c* acquires the predetermined dividing mask DM from the storage region if it is necessary.

Figure 8:
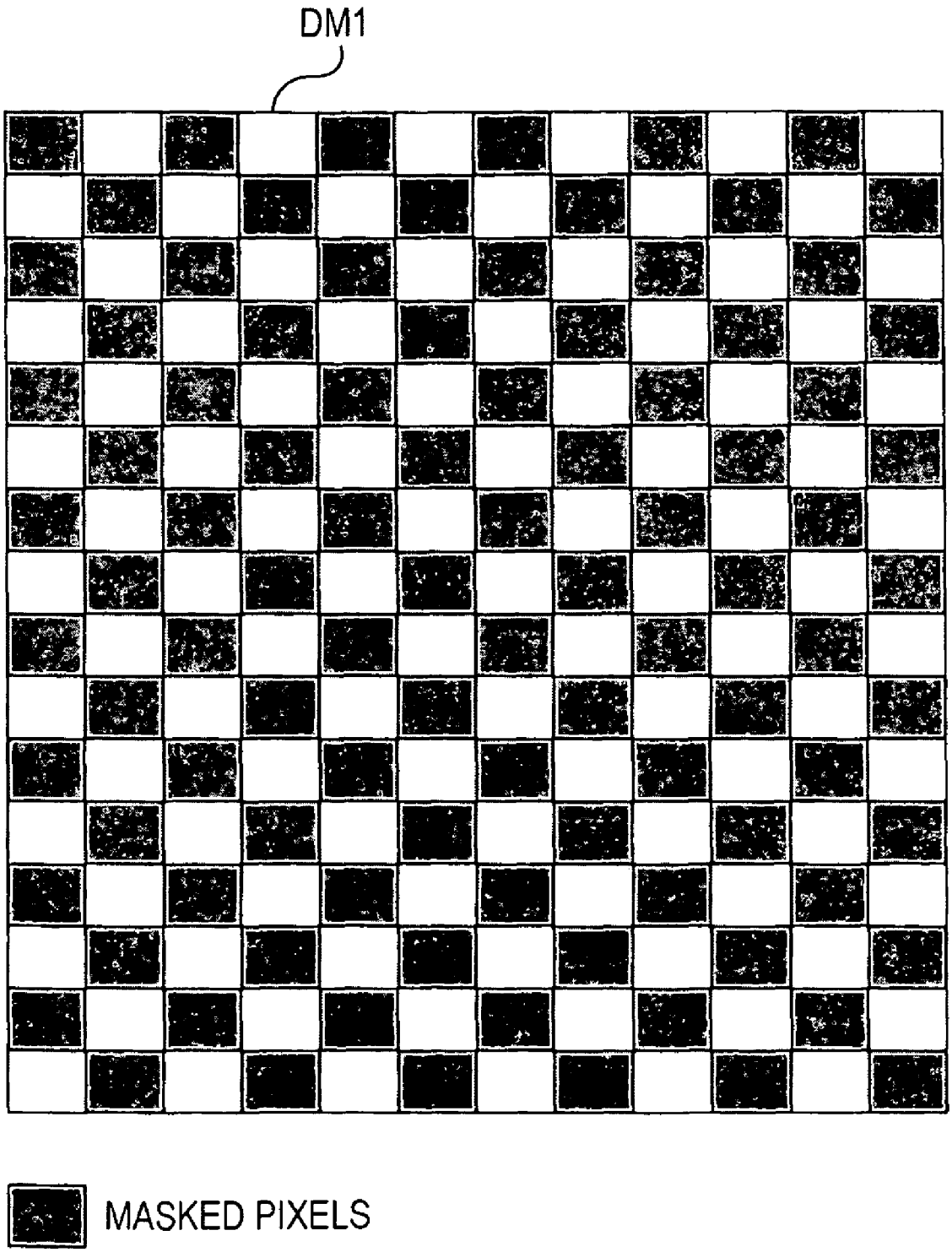
FIG. 8 is a view illustrating one exemplary divided mask.
Figure 9:
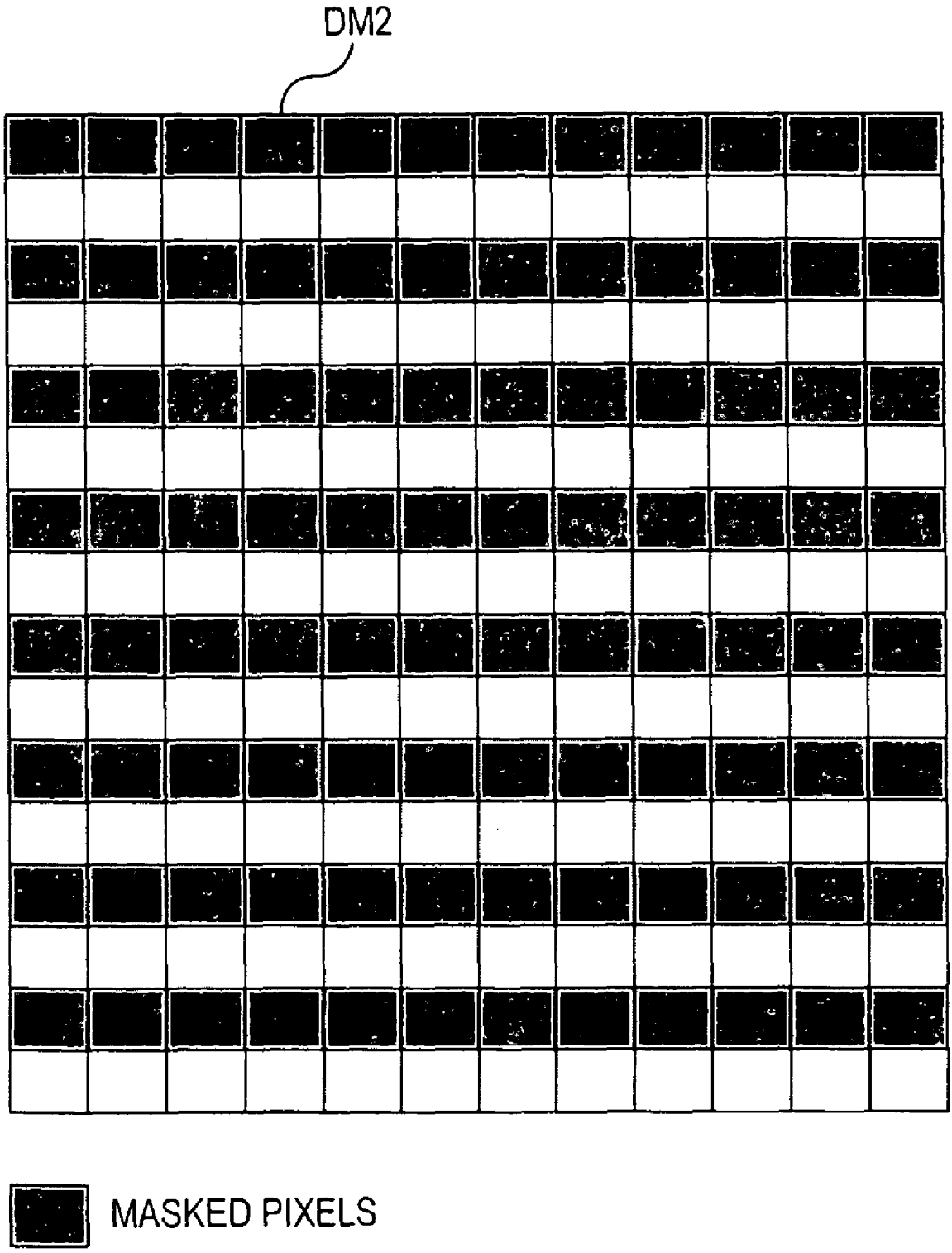
FIG. 9 is a view illustrating another exemplary divided mask.
Figure 10:
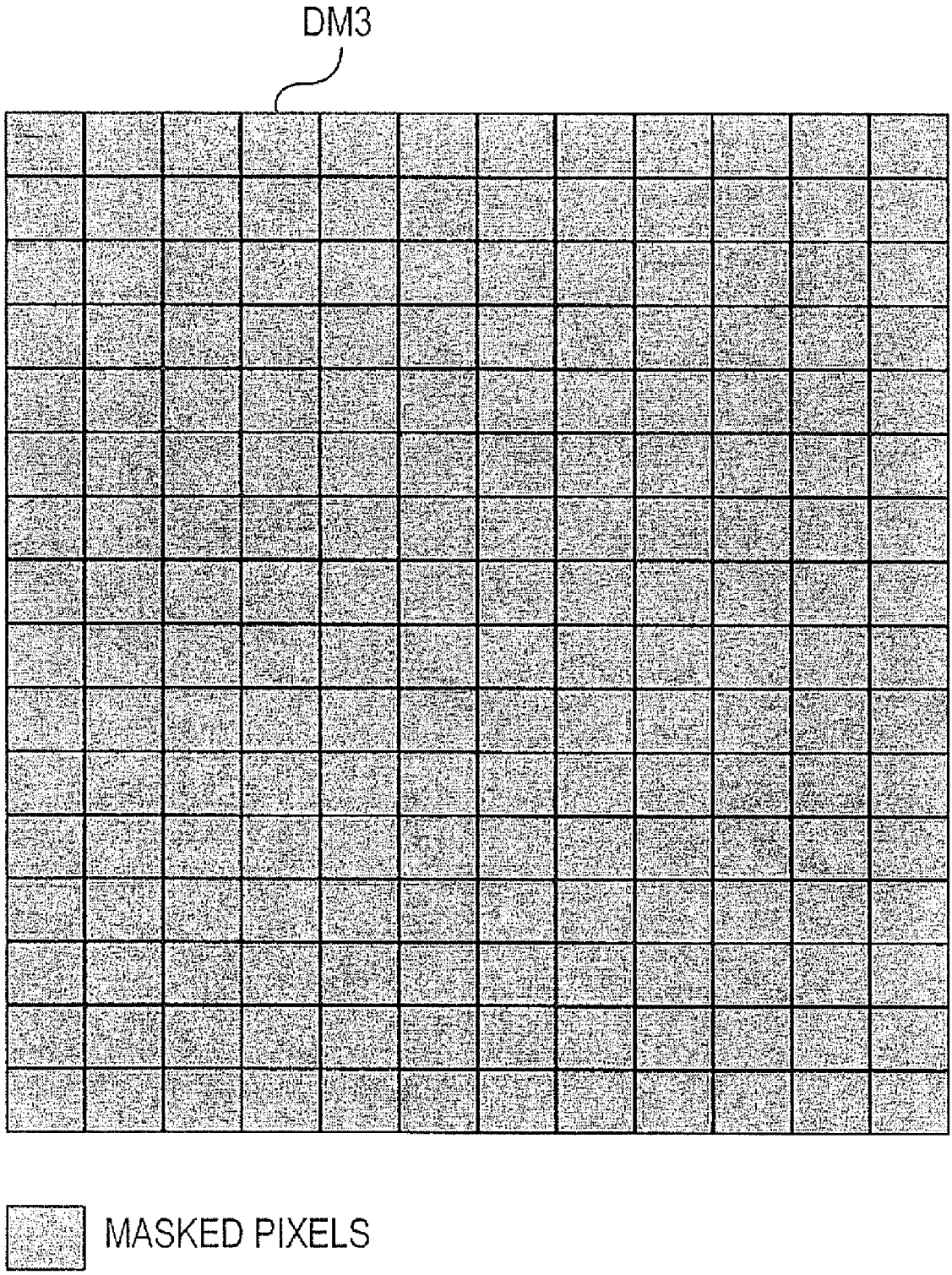
FIG. 10 is a view illustrating the divided mask.

FIGS. 8, 9, and 10 show examples of the dividing mask DM. Each of the dividing masks DM has a predetermined masking pattern, some pixels of a predetermined ratio of the pixels of the image data are masked (covered) when the dividing mask is put on the image data of the processing object. The dividing mask DM1 in FIG. 8 is provided with a masking pattern in a checker board design, the pixels of the image data are masked in a checker pattern when the dividing mask DM1 is put on the image data. The dividing mask DM2 of FIG. 9 is provided with an alternate line masking pattern. When the dividing mask DM2 is put on the image data, every alternate line of the pixels 1 of the image data is masked. A masking ratio of each of the dividing masks DM1 and DM2 is 50%. A dividing mask DM3 of FIG. 10 is a masking pattern having a masking ratio of 100%. That is, when the dividing mask DM3 is put on the image data, the entire pixels are masked. The dividing masks DM are not limited to examples shown in FIGS. 8, 9, and 10. Besides the dividing masks DM1, DM2, and DM3, a pattern for masking 75% of pixels of the entire pixels of the image data, a pattern for masking 25% of pixels of the entire pixels of the image data, and various patterns having various masking ratios can be used. Further, the criteria for choosing the dividing mask DM will be described.

In step S230, the image data dividing module 21*c* divides the image data into the first divided image data and the second divided image data by applying the dividing mask DM selected in step S220 to the image data with respect to which the color conversion processing is performed. In greater detail, the pixels masked when the dividing mask DM is put on the image data in an overlapping manner is taken as the first divided image data, and the pixels unmasked when the dividing mask DM is put on the image data in an overlapping manner is taken as the second divided image data. As a result, for example, when the dividing mask DM2 is used, odd-numbered pixel rows from the upper end of the image are taken as first divided image data, and even-numbered pixel rows are taken as second divided image data. In this aspect, the image data dividing module 21*c* can be realized by the dividing unit.

In step S240, the image data correcting module 21*d* acquires the correction data from the printer 40 via the printer I/F 19*b*. In greater detail, the image data correcting module 21*d* outputs a demand signal of the correction data to the printer 40, the printer 40 which has received the demand signal reads the correction data stored in the storage medium and outputs it to the computer 10. The image data correcting module 21*d* which has acquired the correction data stores the correction data into a predetermined storage area such as HDD 15 as correction data 15*c*.

In step S260, the image data correcting module 21*d* corrects the second divided image data on the basis of the correction data 15*c*.

Figure 11:
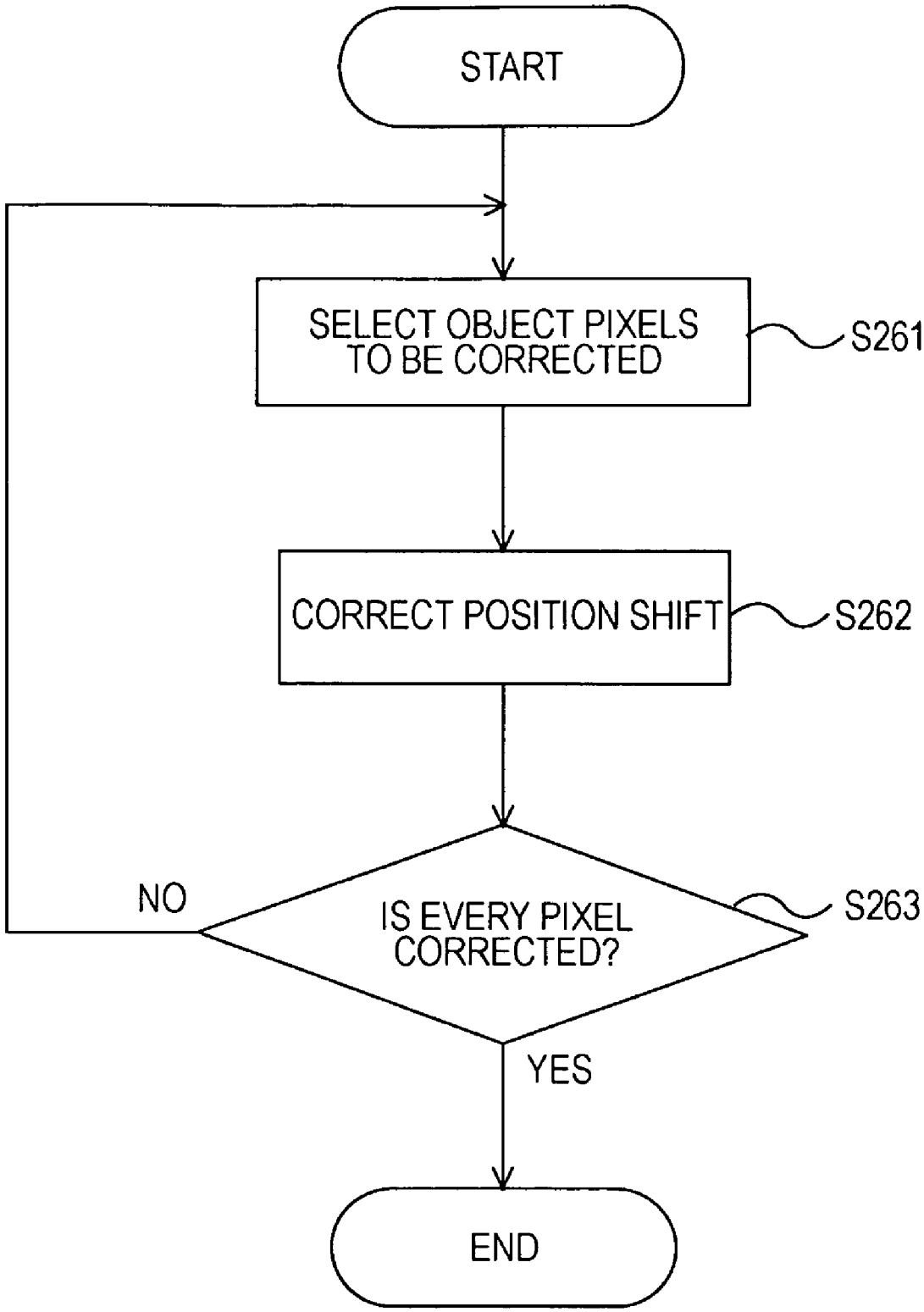
FIG. 11 is a flowchart illustrating correction processing of divided image data.

FIG. 11 is a flowchart illustrating processing of step S260 in detail. In step S261, the image data correcting module 21*d* chooses one pixel to be corrected from the pixels constituting the second divided image data according to the predetermined order. At this time, even though the even-numbered pixel rows of the image data after the color conversion processing are the second divided image data, the entire pixels becomes an object to be corrected. This is because there data is likely to be allocated even to the pixels, to which data is not provided, in the second divided image data obtained after the color conversion processing.

In step S262, the image data correcting module 21*d* reads the correction data 15*c*. Further, data of pixels is calculated by the correction data which is read out. In step S263, the image data collecting module 21*d* determines whether to select the entire pixels constituting the second divided image as an object to be corrected (correction object). In the case in which there exist unselected pixels, the processing is returned to step S261 so that the correction object is selected from the unselected pixels. Then, processing procedures subsequent to step S262 are repeatedly performed. On the other hand, in the case in which the entire pixels constituting the second divided image data are selected as the correction object, the flow of the processing shown in FIG. 11 ends.

Returning to the description of FIG. 7, in the point of view that steps S240 to 260 are performed, the image data correcting module 21*d* realizes the correction data acquiring unit and the correcting unit. Further, when it is considered that the correction data generating module 24 preliminarily generates the correction data, the correction data generating module 24 corresponds to the correction data acquiring unit.

It is not necessary that the order of processing procedures of steps S210 to 260 be the order shown in FIG. 7. For example, the processing selecting the dividing mask DM may be performed before at least the dividing processing of the image data, and acquisition of the correction data from the printer 40 may be performed before the correction processing with respect to the every divided image data. The order of the correction processing of the first divided image data and correction processing of the second divided image data may be reverse to the above or the correction processings may be parallel to each other.

In step S270, the half tone processing module 21*e* performs half tone processing with respect to each of the first divided image data and the second divided image data which have undergone the above-mentioned correction processing. As a result, first half tone data which specifies on or off of dots of each ink color with respect to each of pixels of the first divided image data and second half tone data which specifies on or off of dots of each ink color with respect to each of pixels of the second divided image data can be obtained.

In step S280, the print data generating module 21*f* receives the first half tone data, changes the first half tone data to raster data used for driving the nozzles 42*a* each of the nozzle columns 41*a*1, 41*a*2, 41*a*3, and 41*a*4, and continuously outputs the raster data to the printer 40. The print data generating module 21*f* changes the second half tone data to raster data used for driving the nozzles 42*a* of each of the nozzle columns 41*b*1, 41*b*2, 41*b*3, and 41*b*4 and outputs the raster to the printer 40. As a result, the printing with respect to each of the pixels of the first divided image data is performed by ink ejection from the nozzles 42*a* of the nozzle columns 41*a*1, 41*a*2, 41*a*3, and 41*a*4, and the printing with respect to each of the pixels of the second divided image data is performed by ink ejection from the nozzles 42*a* of the nozzle columns 41*b*1, 41*b*2, 41*b*3, and 41*b*4. That is, one sheet of print image is completed.

The image printed in this manner is printed such that a portion printed by the second head unit 41*b* overlaps with a portion printed by the first head unit 41*a*. As a result, it is possible to eliminate printing blur attributable to the position shift of each of the print head units.

(4) Selection of Dividing Mask

Next, the selection criteria for selecting the dividing mask DM in step S220 will be described. As in this embodiment, multiplexing of the nozzle columns corresponding to ink colors is an object of the heat countermeasure of the nozzles. That is, if the same nozzles were continuously used, the nozzles get heated. As a result, troubles are likely to be caused by the nozzles having high temperature. Accordingly, the image data dividing module 21*c* selects the dividing mask DM in the following manner while taking the heat countermeasure into consideration.

The image data dividing module 21*c* acquires temperature of the first head unit 41*a* in step S220. In this case, the printer 40 is equipped with a temperature sensor which measures temperature of a predetermined position of nozzle columns of the first head unit 41*a*. When the printer 40 receives the demand, the printer 40 sends the measurement result T of the temperature of the first head unit 41*a* to the computer 10 according to the demand of the computer 10. The image data dividing module 21*c* selects the dividing mask DM according to the measurement result T.

FIG. 12 shows a mask determining table 60 illustrating one example of the relationship between the temperature of the first head unit 41*a* and a masking ratio of the dividing mask DM. The table 60 specifies a masking ratio of the dividing mask DM for each temperature range in the temperature band expected to be the measurement result T. In FIG. 12, the asking ratio is 100% when T≦T1, the masking ratio is 75% when T1<T≦T2, the masking ratio is 50% when T2<T≦T3, the making ratio is 25% when T3<T≦T4, and the masking ratio is 0% when T4<T (however, T1<T2<T3<T4). The image data dividing module 21*c* refers the table 60 and selects the dividing mask DM having the masking ration corresponding to the measurement result T.

According to such structure, as the temperature of the nozzle columns of the first head unit 41*a* is higher, the number of pixels of the first divided image data becomes smaller (the number of pixels of the second divided image becomes larger) and a using ratio of the nozzles of the first head unit 41*a* is decreased (a using ratio of the nozzles of the second head unit 41*b* is increased. On the other hand, as the temperature of the nozzle columns of the first head unit 41*a* is lower, the number of pixels of the first divided image data is larger (the number of pixels of the second divided image data is smaller), and the a using ratio of the first head unit 41*a* is increased (a using ratio of the second head unit 41*b* is decreased). That is, of the entire nozzle columns being in the multiplex relationship, a larger portion of nozzle columns having relatively lower temperature is used. Accordingly, it is possible to avoid a problem in which some nozzle columns are more frequently used than other nozzle columns and the frequently used nozzle columns are severely heated to a high temperature.

The dividing mask DM (masking ratio of the dividing mask DM) is selected on the basis of the temperature of the first head unit 41*a*, but the dividing mask DM may be selected according to a difference between the temperatures of the first head unit 41*a* and the second head unit 41*b*. In this case, the image data dividing module 21*c* acquires the temperature of the first head unit 41*a* and the temperature of the second head unit 41*b* in step S220. That is, besides the temperature sensor, the printer 40 is equipped with an additional temperature sensor which measures temperature of a predetermined position of the nozzle columns of the second head unit 41*b*. Thus, the measurement result Ta of the temperature of the first head unit 41*a* and the measurement result Tb of the temperature of the second head unit 41*b* are sent to the computer 10 according to the demand from the computer 10. The image data dividing module 21*c* obtains a differential T of the measurement results Ta and Tb by an equation of T=Ta−Tb. To which value range of value ranges T1 to T4 the differential T belongs determines the masking ratio using the mask determining table 60, and the dividing mask DM having the determined masking ratio is selected.

However, in the case of determining the masking ratio on the basis of the differential T, the temperatures T1 to T4 in the mask determining table 60 shown in FIG. 14 are read out as critical values T1 to T4, and the critical values T1 to T4 are in the relationship of T1<T2<T3<T4. The critical values T1 and T2 are negative values and the critical values T3 and T4 are positive values. According to such structure, when there is a tendency that the first head unit 41*a* has a higher temperature than the second head unit 41*b*, the number of pixels of the first divided image data become smaller, and the using ratio of the nozzles of the first head unit 41*a* is decreased. On the other hand, when there is a tendency that the second head unit 41*b* has a higher temperature than the first head unit 41*a*, the number of pixels of the first divided image data becomes larger, and the using ratio of the nozzles of the first head unit 41*a* is increased. That is, among the nozzle columns which are in the multiplex relationship, the nozzles having a relatively lower temperature are used with a higher using ratio. Accordingly, it is possible to properly suppress the increase of the temperature of the nozzle columns.

Figure 13:
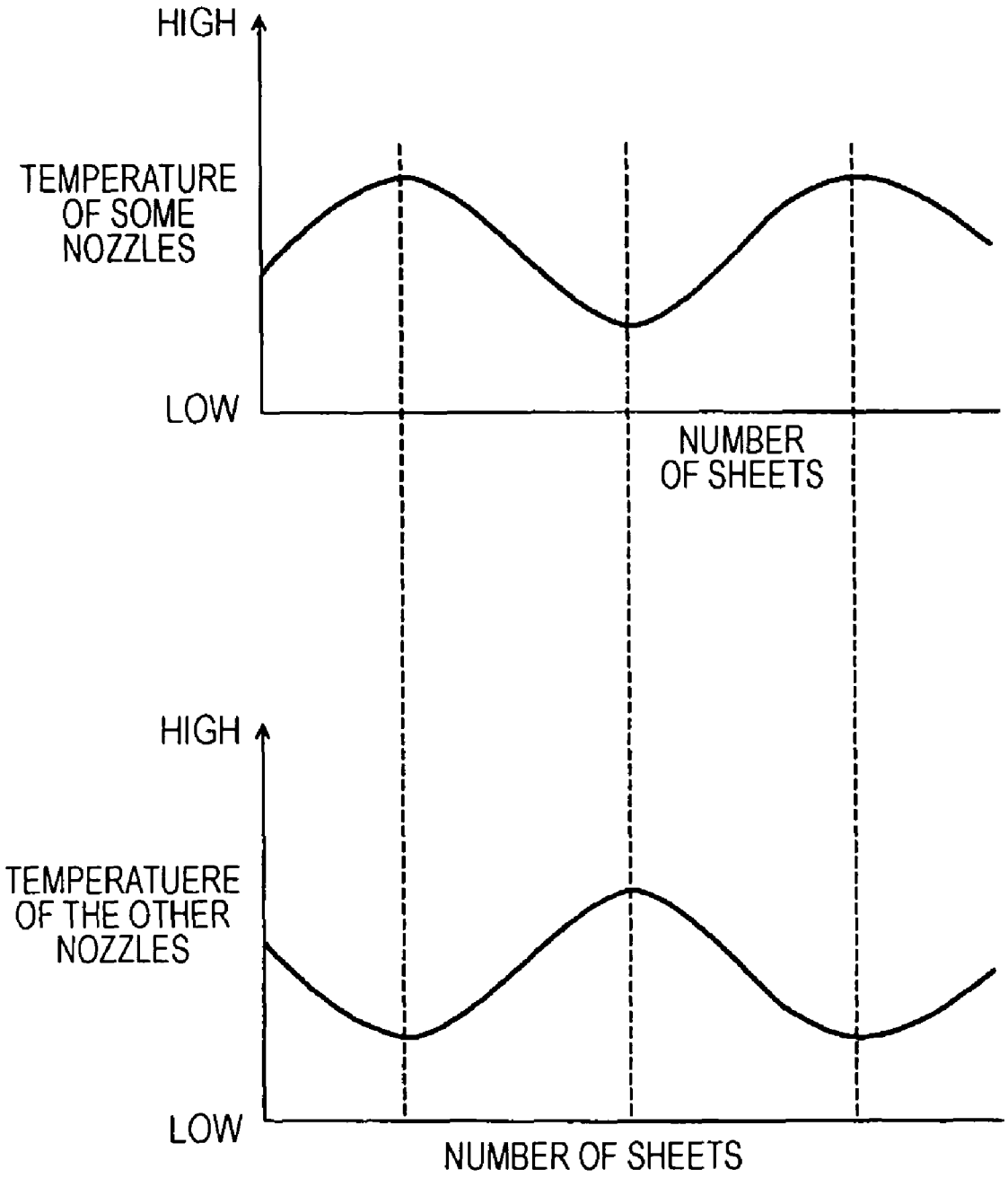
FIG. 13 is a view illustrating the temperature change of each of nozzle columns.

The method of selecting the dividing mask DM, taking the heat countermeasure into consideration, is not limited to the above described method. For example, as shown in FIG. 13, the image data dividing module 21*c* may select the dividing mask DM such that temperature of some nozzle columns of the entire nozzle columns which are multiplexed and temperature of the other nozzle columns are changed with almost reverse phase. For example, the image data dividing module 21*c* changes the dividing masks DM such that the masking ratio of the dividing masks DM changes in order of 50%, 75%, 100%, 75%, 50%, 25%, 0%, 25%, and 50%. The changing timing is every sheet of print image or every predetermined number of sheets of print image. If the dividing masks DM are changed in this way, the rising and falling of the nozzle using ratios are precisely opposite to each other at the same timing in some nozzle columns of the nozzle columns which are multiplexed and the other nozzle columns. As a result, temperature change curves representing repeat of the temperature rising and the temperature falling have the opposite phase to each other. Accordingly, it is possible to avoid the situation in which both of the nozzle columns on one side and the nozzle columns on the other side are at high temperature, and thus it is possible to prolong the lifespan of the nozzle columns on both sides.

Another purpose of multiplexing the nozzle columns corresponding to ink colors is to avoid using abnormal nozzles. That is, if the nozzle columns corresponding to the ink colors are multiplexed, even though the nozzles of the nozzle columns on one side are out of order, the nozzle columns on the other side are normal used and thus normal printing can be performed. For example, the image data dividing module 21*c* acquires ejection failure information of the first head unit 41*a* in step S220. In this case, the printer 40 is equipped with an ink ejection detector which detects ink ejection of each of the nozzles 42*a* (with respect to the entire or some nozzles) of the first head unit 41*a*. The printer 40 sends the previous detection result by the ink ejection detector to the computer 10 according to a demand for the ejection failure information, which is sent by the computer 10. The image data dividing module 21*c* receives the detection result as the ejection failure information, analyzes the information, and determines such that the nozzle columns of the first head unit 41*a* is in the failure state when a predetermined number or more nozzles 42*a* of the entire nozzles 42*a* of the first head unit 41*a* is in the failure state.

In this case, the image data dividing module 21*c* selects the dividing mask DM having a masking ratio of 0% (or the dividing mask DM having a masking ratio of almost 0%). As a result, the number of pixels of the first divided image data is 0 or almost 0, and the entire pixels or almost pixels representing the printing object image are printed by the nozzle columns of the second head unit 41*b*. Accordingly, it is possible to avoid a situation in which the printing is performed by the nozzle columns of the first head unit 41*a* having a large number of nozzles 42*a* being in the ink ejection failure state. Further, the printer 40 may be equipped with an ink ejection detector which detects ink ejection of the nozzles 42*a* (the entire nozzles or some nozzles) of the second head unit 41*b*. Between the first head unit 41*a* and the second head unit 41*b*, the image data dividing module 21*c* may select the dividing masks DM such that a larger number of pixels of the head unit having a relatively smaller number of lines of nozzles 42*a* which are in the ink ejection state is used for printing.

In addition, the image data dividing module 21*c* may choose a dividing mask DM according to the instructions which is externally input. That is, when a user makes an instruction for choosing a dividing mask DM via the UI screen, the dividing mask DM according to the choosing instruction is read out from a storage region such as the HDD 15 and is applied to dividing processing of the image data.

(5) Modification

With the above-mentioned embodiment, the correction data for harmonizing the printing data by the second head unit 41*b* with the printing result by the first head unit 41*a* is generated. As a result, both of printing position misalignment attributable to the position shift of the first head unit 41*a* and printing position misalignment attributable to the position shift of the second head unit 41*b* are incorporated with the correction data of the second head unit 41*b*, and the correction is performed using such correction data. However, correction data for each divided image data of each of the print head unit may be generated, and the printing result of each of the print head units may be present at a reference position.

In greater detail, information about a position of the paper, at which the test pattern is printed, may be provided to the correction data generating module 24 as the reference position. However, another position may be used as the reference. For example, in the rotation correction, the horizontal direction may be used as the reference. In this case, the correction data which rotates each of the pixels under the condition of $\theta=\alpha$ with respect to the first divided image data is generated, and the correction data which rotates each of the pixel rows under the condition of $\theta=\beta$ with respect to the second divided image data is generated. That is, in every head unit, since the pixel rows are printed in parallel with the horizontal direction, there may be no possibility that the inclination occurs in the printing result. Further, when the horizontal direction is used as the reference in the rotation correction, correction data which makes each of the pixel rows to be elongated by applying $1/\cos\alpha$ to the first divided image data and correction data which makes each of the pixel rows to be elongated by applying $1/\cos\beta$ to the second divided image data are generated, respectively. Further, in the shift correction, the printing result by any one of the print head units may be used as the reference. On the other hand, alternatively, the printing results of the print head units are shifted to a midway position of the printing results of the print head units.

As described above, when the correction is performed with respect to the first and second divided image data, in step S260, the correction is performed with respect to the first divided image data as well as the second divided image data. The correction is performed with respect to each piece of the divided image data. With such correction, even though the inclination deviation of the first head unit 41*a* is large, the printing result by the second head unit 41*b* is unified with the printing result by the first head unit 41*a*. Accordingly, it is possible to solve the problem that the printing result which is inclined is generated even through print blurring of the printing result of the corrected image data is eliminated.

The structures of the liquid ejection control device and the liquid ejection device are applied to a device including the printer 40 serving as an ink-jet type recording device or the printer 40. However, application objects of the structures of the liquid ejection control device and the liquid ejection device are not limited thereto. For example, the invention may be applied to a fluid ejection device which ejects liquid other than ink (including liquid material in which functional material powder is dispersed in liquid, and fluid material, such as gel) or fluid other than liquid (solid which can be sprayed as liquid). For example, the liquid ejection apparatus of the invention may be applied to a liquid ejection apparatus which ejects liquid material containing electrode material or color material used in a manufacturing process of liquid crystal displays, electroluminance (EL) displays and surface discharge displays in a dispersed form of a dissolved form, a liquid ejection apparatus which ejects bioorganic material used in a manufacturing process of biochips, and a liquid ejection apparatus which ejects liquid serving as samples used as a precision pipette. In addition, the invention may be applied to a liquid ejection apparatus which ejects a lubricant as a pin point in a precision machinery, such as a watch and a camera, a liquid ejection apparatus which ejects transparent resin in the form of liquid, such as ultraviolet ray curable resin used for forming micro-hemispherical lenses (optical lenses) utilized in optical communication elements, on a substrate, a liquid ejection apparatus which ejects a liquid etchant, such as acid or alkali used for etching a substrate, a liquid ejection apparatus which ejects gel, or a powder ejection type recording apparatus which ejects solid in the form of power, such as toner.

The invention is not limited to the above-mentioned embodiments and modifications. The invention may include structures in which elements disclosed in the embodiments and modifications are replaced with one another or combination of these elements is changed and structure in which elements disclosed in known techniques, the embodiments, and the modifications are replaced with one another and combination of these elements is changed.

What is claimed is:

1. A liquid ejection control device controlling a liquid ejecting mechanism having a plurality of liquid ejection heads, comprising:

a dividing unit to which image data consisting of a plurality of pixels is inputted and which divides the image data into a plurality of pieces of divided image data, each corresponding to pixels which undergo a liquid ejection, of each of the liquid ejection heads;

a correction data acquiring unit which acquires correction data eliminating a deviation of liquid ejection locations of the plurality of liquid ejection heads;

a correcting unit which corrects the divided image data on the basis of the correction data; and a liquid ejection controlling unit which performs liquid ejection control by which each of the liquid ejection heads is driven on the basis of the divided image data which is corrected.

2. The liquid ejection control device according to claim 1, wherein the correction data is produced on the based of a result obtained by causing each of the plurality of liquid ejection heads to perform an liquid ejection according to a predetermined test pattern, and wherein the predetermined test pattern includes at least a pattern representing a parallel direction of liquid ejection nozzles of the liquid ejection head and a pattern representing a movement direction of the liquid ejection head, which is relative to a medium to which liquid is ejected.

3. The liquid ejection control device according to claim 1, wherein the correcting unit generates correction data which harmonizes a liquid ejection result by one liquid ejection heads of the plurality of liquid ejection heads with a liquid ejection result by another liquid ejection head.

4. The liquid ejection control device according to claim 1, wherein the correcting unit generates correction data which corrects liquid ejection results by the plurality of liquid ejection heads to be formed at a predetermined reference position.

5. The liquid ejection control device according to claim 1, wherein the dividing unit acquires dividing masks which mask a predetermined ratio of pixels of the image data in a predetermined masking pattern, the pixels masked by the dividing masks of the pixels of the image data form the divided image data corresponding to one of the liquid ejection heads, and pixels which are not masked by the dividing masks of the pixels of the image data form divided image data corresponding to the remaining liquid ejection head.

6. A liquid ejection control method for controlling a liquid ejecting mechanism having a plurality of liquid ejection heads, comprising:

a dividing process in which a dividing unit, to which image data consisting of a plurality of pixels is inputted, divides the image data into a plurality of pieces of divided image data, each consisting of pixels, which undergo a liquid ejection, of each of the liquid ejection heads;

a correction data acquiring process in which a correction data acquiring unit acquires correction data which eliminates a deviation of liquid ejection locations of the plurality of liquid ejection heads;

a correction process in which a correcting unit corrects the divided image data on the basis of the correction data; and a liquid ejection control process in which a liquid ejection controlling unit performs liquid ejection control, by which each of the liquid ejection heads is driven on, on the basis of the divided image data which is corrected.

* * * * *